US005597164A

United States Patent [19]

Dodds

[11] Patent Number: 5,597,164

[45] Date of Patent: Jan. 28, 1997

[54] DRAW TIMER TARGET FOR PAINT BALL GUNS, PELLET GUNS, AND THE LIKE

[76] Inventor: Denis Dodds, 10737-135 A St., Surrey B.C., Canada, V3T 4E3

[21] Appl. No.: 586,204

[22] Filed: Jan. 16, 1996

[51] Int. Cl.[6] ..... F41J 5/052

[52] U.S. Cl. ..... 273/371; 273/374

[58] Field of Search ..... 273/376, 371, 273/446, 372, 374, 375, 377, 378

[56] References Cited

U.S. PATENT DOCUMENTS

| | | | |
|---|---|---|---|
| 1,316,792 | 9/1919 | Hanson | 273/376 |
| 2,592,429 | 4/1952 | Kimmel et al. | 273/376 |
| 2,695,173 | 11/1954 | Sterne | 273/376 |
| 3,558,132 | 1/1971 | Miller | 273/446 |
| 3,802,098 | 4/1974 | Sampson et al. | 273/376 |
| 3,972,531 | 8/1976 | Knapp | 273/376 |
| 4,142,723 | 3/1979 | Rief | 273/376 |
| 5,320,358 | 6/1994 | Jones | 273/371 |

*Primary Examiner*—Mark S. Graham

[57] ABSTRACT

Draw timer target including a mounting plate coupled within an interior space of a housing. Also included is a lamp centrally situated on the mounting plate. The lamp is adapted to emit light outwardly from the housing upon the actuation thereof. A numeric light emitting diode display is also coupled to the mounting plate and adapted to display a timer. Further included is a resilient target plate coupleable to the mounting plate and comprising a circular transparent window and a rectangular transparent window, whereby the lamp and numeric display are visible therethrough. The present invention also has a switch mechanism positioned adjacent to the target plate and adapted to actuate upon the impact of a projectile on the target plate. Finally, control circuitry is adapted to actuate the lamp and depict an incrementing timer on the display upon the depression of an actuator button. The control circuitry is further adapted to stop the timer, turn off the lamp, and depict the time at which the timer stopped on the display upon the actuation of the switching mechanism.

1 Claim, 3 Drawing Sheets

DRAW TIMER TARGET FOR PAINT BALL GUNS, PELLET GUNS, AND THE LIKE

BACKGROUND OF THE INVENTION

1. Field of the Invention

The present invention relates to a draw timer target and more particularly pertains to timing a user's ability to shoot a target with a paint ball gun, pellet gun, wax gun, or the like.

2. Description of the Prior Art

The use of target systems is known in the prior art. More specifically, target systems heretofore devised and utilized for the purpose of measuring the accuracy of a user's ability to shoot a target are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 5,194,006 to Zaenglein, Jr. a shooting simulating process and training device for accurately and reliably detecting the impact time and location in which a projectile from a firearm hits a moving target. U.S. Pat. No. 4,898,391 Kelly et al. discloses a target shooting game, wherein the first player must hit and disable a target. U.S. Pat. No. 5,320,358 to Jones discloses a shooting game having flip-up targets spaced along a game course. Lastly, U.S. Pat. Nos. 3,870,305 to Harclerode; 5,219,173 to Vit et al.; 5,222,740 to Wu et al. are provided as being of general interest.

In this respect, the draw timer target for paint ball guns, pellet guns, and the like according to the present invention substantially departs from the conventional concepts and designs of the prior art, and in so doing provides an apparatus primarily developed for the purpose of timing a user's ability to shoot a target with a paint ball gun, pellet gun, wax gun, or the like.

Therefore, it can be appreciated that there exists a continuing need for a new and improved draw timer target for paint ball guns, pellet guns, and the like which can be used for timing a user's ability to shoot a target with a paint ball gun, pellet gun, wax gun, or the like. In this regard, the present invention substantially fulfills this need.

SUMMARY OF THE INVENTION

In view of the foregoing disadvantages inherent in the known types of target systems now present in the prior art, the present invention provides an improved draw timer target for paint ball guns, pellet guns, and the like. As such, the general purpose of the present invention, which will be described subsequently in greater detail, is to provide a new and improved draw timer target for paint ball guns, pellet guns, and the like apparatus and method which has all the advantages of the prior art and none of the disadvantages.

To attain this, the present invention essentially comprises a square housing having a top surface, bottom surface, and pair of side surfaces defining a periphery and an interior space with an open front face and an open rear face. The housing further comprises a rectangular mounting plate coupled within the interior space adjacent to the front face, whereby the periphery positioned adjacent to the front face forms a flange. Also included is a lamp centrally situated on the mounting plate. The lamp is adapted to emit light outwardly from the front face upon the actuation thereof. Four push button switches are each coupled to a front surface of the mounting plate in a different quadrant thereof.

The push button switches are connected in parallel thereby allowing the passage of current therethrough upon the depression of at least one of the switches. A numeric light emitting diode display with a rectangular configuration is coupled to the front face of the mounting plate adjacent to the top surface of the housing. Further included is a resilient target plate with square configuration. The target plate has a length and width approximately equal to a length and width of an inner surface of the periphery of the housing. The target plate comprises a circular transparent window centrally situated therein whereby the lamp is visible therethrough. A rectangular transparent window is situated adjacent to a top edge of the target plate, whereby the display is visible therethrough. Four apertures are each situated in different quadrants of the target plate. For coupling the target plate to the housing, four screws are adapted to insert within the apertures of the target plate and screwably couple within four threadedly lined bores formed in different quadrants of the mounting plate. The four screws each comprise a conventional helical spring coupled thereabout. The springs are biased between the mounting plate and target plate thereby holding the target plate flush with the front face of the housing. Upon biasing, the springs allow resilient depression of the switches by the rear surface of the target plate. For starting the present invention, an actuator button is included. The actuator button is adapted to communicate an actuating signal upon the depression thereof. Finally, control circuitry is coupled to the mounting board and connected to the lamp, display, switches, actuator button, and a transformer. The transformer is adapted to supply power thereto upon the receipt of an alternating current from a conventional power receptacle. The control circuitry is adapted to actuate the lamp and depict an incrementing timer on the display upon the receipt of the actuating signal from the actuator button. The control circuitry is further adapted to stop the timer, turn off the lamp, and depict the time at which the timer stopped on the display upon the depression of at least one of the push button switches.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved draw timer target for paint ball guns, pellet guns, and the like which has all the advantages of the prior art target systems and none of the disadvantages.

It is another object of the present invention to provide a new and improved draw timer target for paint ball guns, pellet guns, and the like which may be easily and efficiently manufactured and marketed.

It is a further object of the present invention to provide a new and improved draw timer target for paint ball guns, pellet guns, and the like which is of a durable and reliable construction.

An even further object of the present invention is to provide a new and improved draw timer target for paint ball guns, pellet guns, and the like which is susceptible of a low cost of manufacture with regard to both materials and labor, and which accordingly is then susceptible of low prices of sale to the consuming public, thereby making such draw timer target for paint ball guns, pellet guns, and the like economically available to the buying public.

Still yet another object of the present invention is to provide a new and improved draw timer target for paint ball guns, pellet guns, and the like which provides in the apparatuses and methods of the prior art some of the advantages thereof, while simultaneously overcoming some of the disadvantages normally associated therewith.

Still another object of the present invention is to time a user's ability to shoot a target with a paint ball gun, pellet gun, wax gun, or the like.

Lastly, it is an object of the present invention to provide a new and improved draw timer target including a mounting plate coupled within an interior space of a housing. Also included is a lamp centrally situated on the mounting plate. The lamp is adapted to emit light outwardly from the housing upon the actuation thereof. A numeric light emitting diode display is also coupled to the mounting plate and adapted to display a timer. Further included is a resilient target plate coupleable to the mounting plate and comprising a circular transparent window and a rectangular transparent window, whereby the lamp and numeric display are visible therethrough. The present invention also has a switch mechanism positioned adjacent to the target plate and adapted to actuate upon the impact of a projectile on the target plate. Finally, control circuitry is adapted to actuate the lamp and depict an incrementing timer on the display upon the depression of an actuator button. The control circuitry is further adapted to stop the timer, turn off the lamp, and depict the time at which the timer stopped on the display upon the actuation of the switching mechanism.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figures 1, 2:
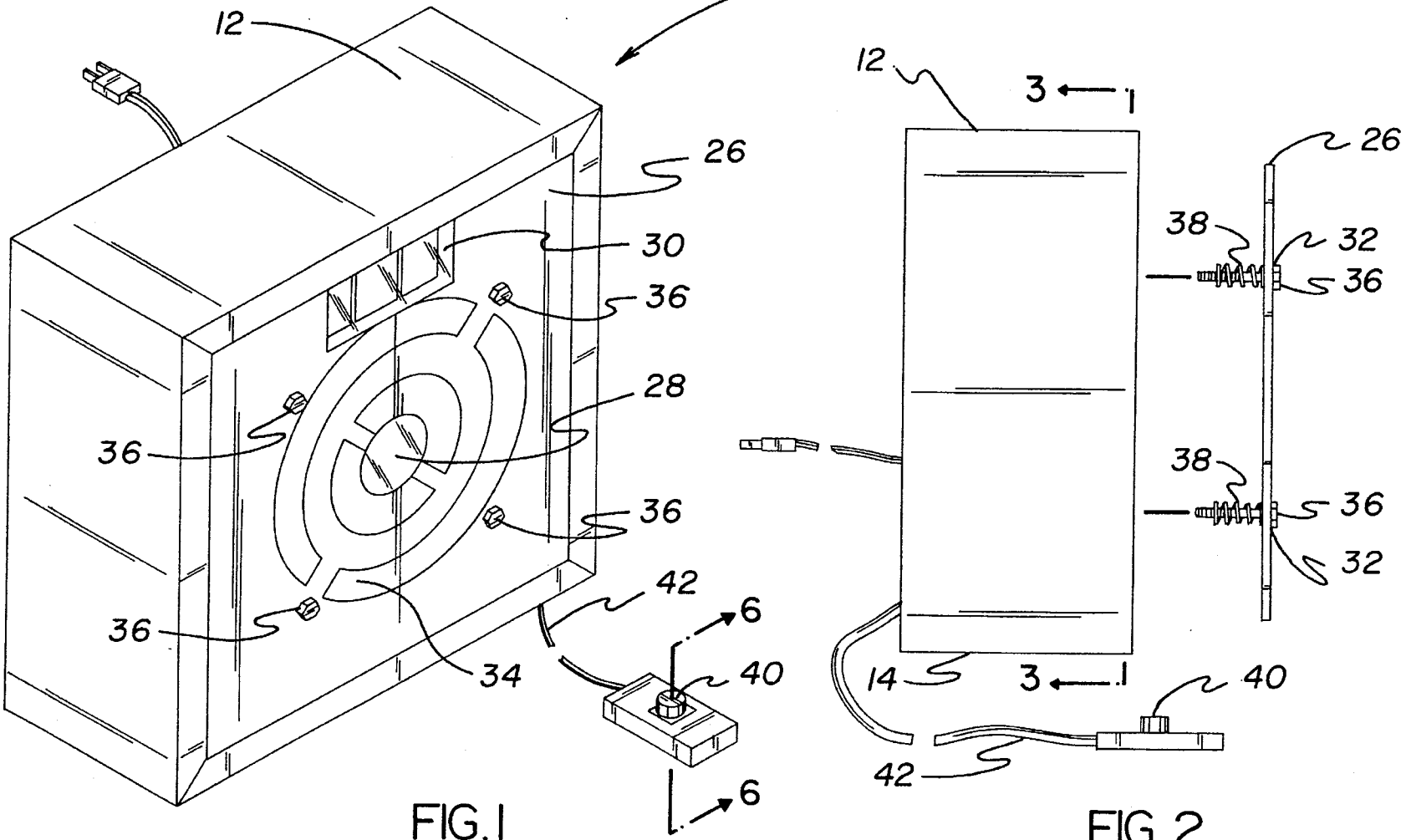
FIG. 1 is a perspective illustration of the preferred embodiment of the draw timer target for paint ball guns, pellet guns, and the like constructed in accordance with the principles of the present invention.
FIG. 2 is a side plan view of the present invention with the target plate removed.
Figure 7:
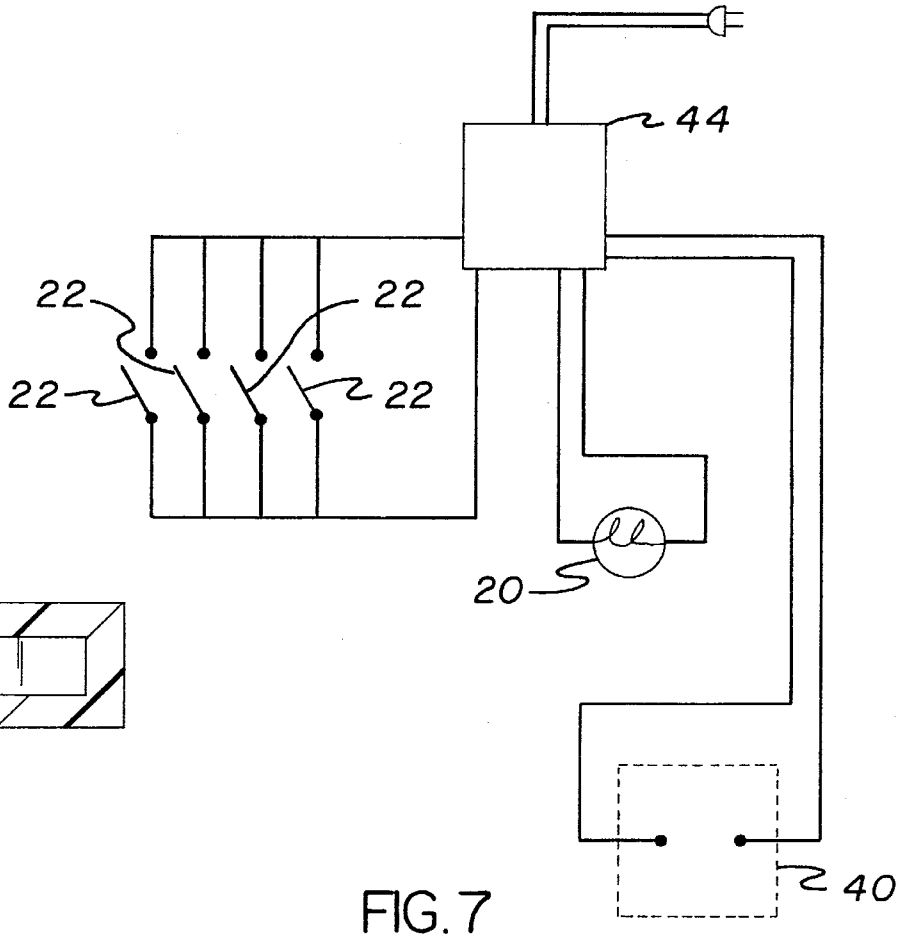
FIG. 7 is a schematic of the circuitry employed in the present invention.
Figure 5:
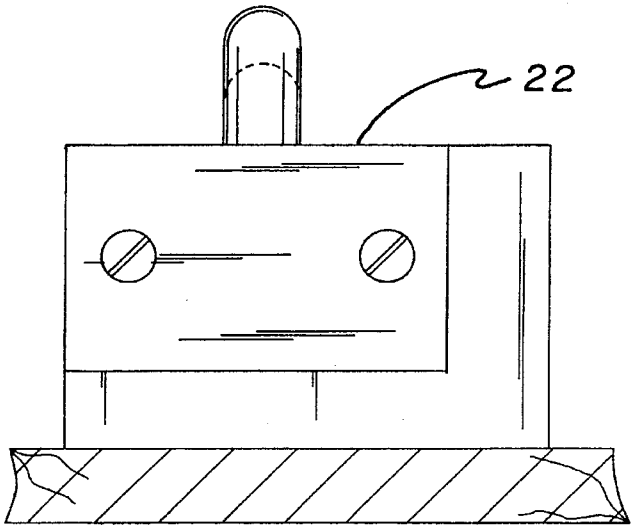
FIG. 5 is a close-up side plan view of one of the push button switches employed in the present invention.
Figure 6:
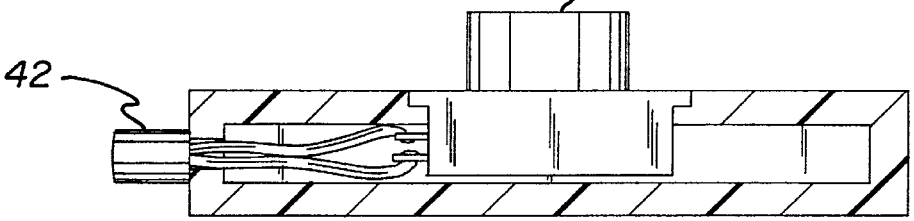
FIG. 6 is a cross-sectional front view taken along Line 6—6 depicted in FIG. 1.
Figure 4:
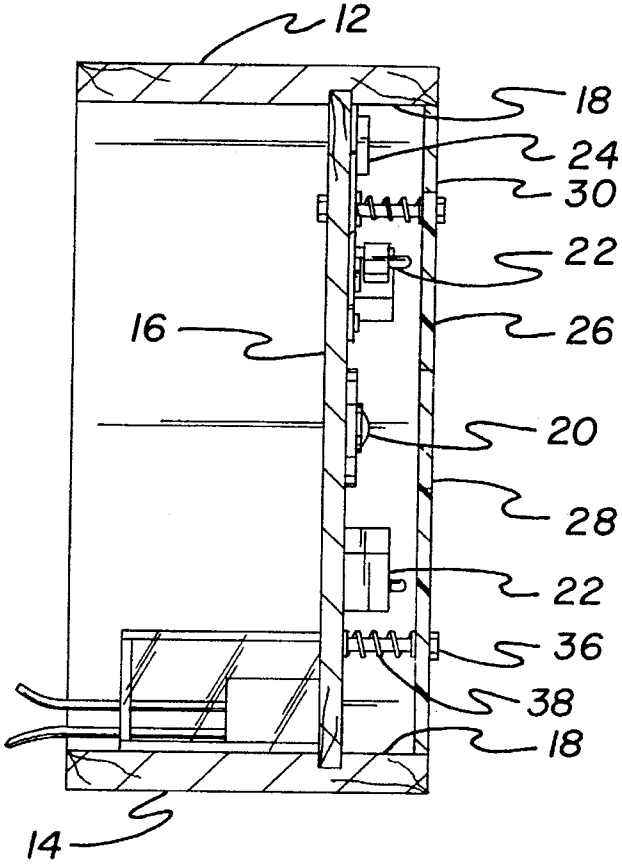
FIG. 4 is a cross-sectional side view of the present invention depicting all of the major components thereof.
Figure 3:
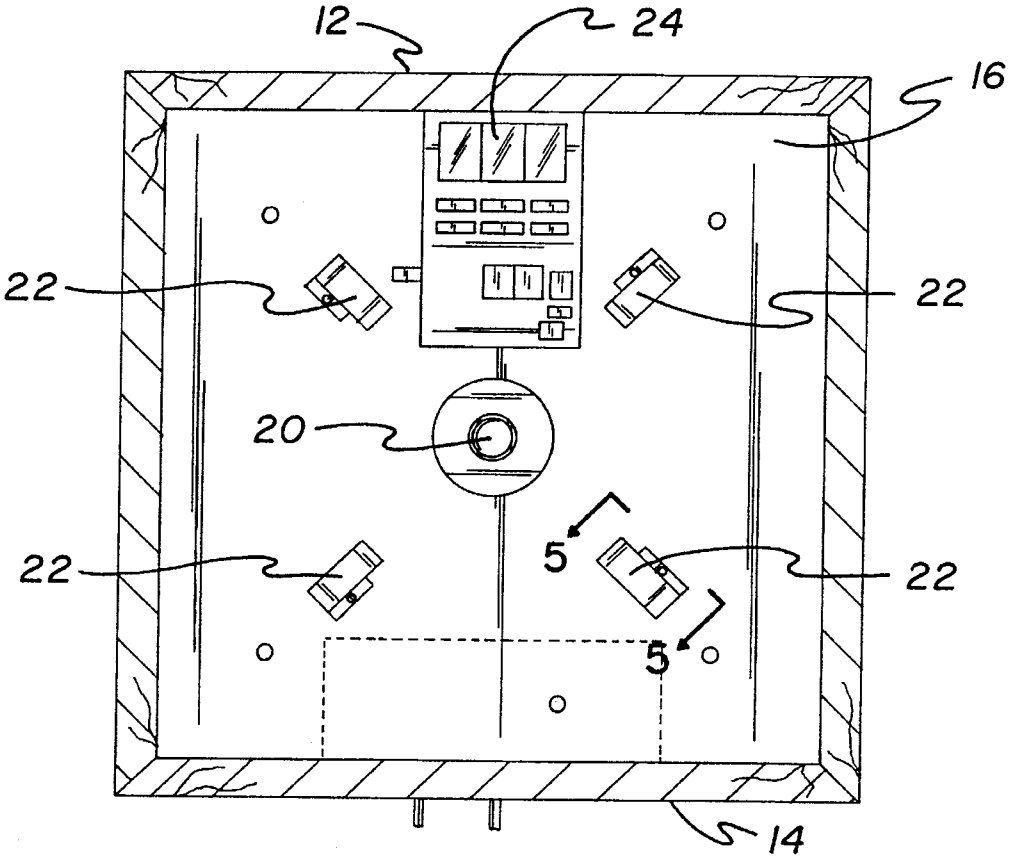
FIG. 3 is a cross-sectional front view taken along Line 3—3 depicted in FIG. 2.

With reference now to the drawings, and in particular to FIG. 1 thereof, a new and improved draw timer target for paint ball guns, pellet guns, and the like embodying the principles and concepts of the present invention and generally designated by the reference numeral 10 will be described.

The present invention, the new and improved draw timer target for paint ball guns, pellet guns, and the like, is comprised of a plurality of components. Such components in their broadest context include a housing, lamp, switches, timer display, target, actuator button, and control circuitry. Such components are individually configured and correlated with respect to each other so as to attain the desired objective.

More specifically, it will be noted that system 10 of the present invention includes a square housing having a top surface 12, bottom surface 14, and pair of side surfaces defining a periphery and an interior space with an open front face and an open rear face. The housing has a height of approximately 14 inches, width of approximately 14 inches, and depth of approximately 6 inches. The housing further comprises a rectangular mounting plate 16 coupled within the interior space adjacent to the front face, whereby the periphery positioned adjacent to the front face forms a flange 18. The housing is preferably comprised of wood.

Also included is a lamp 20 centrally situated on the mounting plate. The lamp is adapted to emit light outwardly from the front face upon the actuation thereof.

Four push button micro-switches 22 are each coupled to a front surface of the mounting plate in a different quadrant thereof. The push button switches are connected in parallel thereby allowing the passage of current therethrough upon the depression of at least one of the switches.

A numeric light emitting diode display 24 with a rectangular configuration is coupled to the front face of the mounting plate. The numeric display is positioned adjacent to the top surface of the housing and is adapted to display a 3-digit number.

Further included is a resilient target plate 26 with square configuration. The target plate is preferably constructed of a thin metallic material which is impenetrable to paint balls, wax pellets, dart guns, and the like and can also be easily cleaned. The target plate has a length and width of approximately 14 inches. The target plate further comprises a circular transparent window 28 centrally situated therein whereby the lamp is visible therethrough. A rectangular transparent window 30 is situated adjacent to a top edge of the housing, whereby the display is visible therethrough. Four apertures 32 are each situated in different quadrants of the target plate. The target plate further has circular markings 34 encompassing the circular window for aiding in the targeting thereof.

For coupling the target to the housing, four screws 36 are adapted to insert within the apertures of the target plate and screwably couple within four threadedly lined bores formed in different quadrants of the mounting plate. The four screws each comprise a conventional helical spring 38 coupled thereabout. The springs are biased between the mounting plate and a rear surface of the target plate thereby holding the target plate flush with the front face of the housing. Upon biasing, the springs allow resilient depression of the switches by the rear surface of the target plate. The screws are also removable for allowing removal and cleaning of the target plate or repair of the device.

For starting the present invention, an actuator button 40 is included. The actuator button is adapted to communicate an actuating signal upon the depression thereof. The actuator button also includes a control line 42 for transmitting the signal from afar. In an alternate embodiment, a radio link may be employed as a substitute for the control line.

Finally, control circuitry 44 is coupled to the mounting board and connected to the lamp, display, switches, actuator button, and a transformer. The transformer is adapted to supply power thereto upon the receipt of an alternating current from a conventional power receptacle. The control circuitry is adapted to actuate the lamp and depict an incrementing timer on the display upon the receipt of the actuating signal from the actuator button. The control circuitry is further adapted to stop the timer, turn off the lamp, and depict the time at which the timer stopped on the display upon the depression of at least one of the push button switches.

The present invention provides a fast draw timer target for measuring and displaying the time required to hit a target with a paint ball gun, pellet gun, suction-cup dart gun, wax bullet gun, or the like. Such a device is a safe alternative to the products produced by the black powder fast draw industry.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A draw timer target for paint ball guns and pellet guns comprising, in combination:

a square housing constructed of wood having a top surface, a bottom surface, and a pair of side surfaces defining a periphery and an interior space with an open front face and an open rear face, the housing further comprising a rectangular mounting plate coupled within the interior space adjacent to the front face whereby the periphery adjacent to the front face forms a flange;

a lamp centrally situated on the mounting plate, the lamp adapted to emit light outwardly from the front face upon the actuation thereof;

four push button switches each coupled to a front surface of the mounting plate in a different quadrant thereof, the push button switches connected in parallel thereby allowing the passage of current therethrough upon the depression of at least one of the switches;

a numeric light emitting diode display with a rectangular configuration coupled to the front face of the mounting plate and positioned adjacent to the top surface of the housing, the numeric light emitting diode display adapted to display a 3-digit number;

a resilient target plate with square configuration having a length and a width approximately equal to a length and a width of an inner surface of the periphery of the housing, the resilient target plate constructed of a thin metallic material which is impenetrable to non-lethal guns, the target plate further comprising a circular transparent window centrally situated therein whereby the lamp is visible therethrough, a rectangular transparent window situated adjacent to a top edge thereof whereby the display is visible therethrough, and four apertures each situated in different quadrants of the target plate, the target plate further having circular markings encompassing the circular window for aiding in the targeting thereof;

four screws adapted to insert within the apertures of the target plate and screwably couple within four threadedly lined bores formed in different quadrants of the mounting plate, the four screws each comprising a spring coupled thereabout and biased between the mounting plate and the rear surface of the target plate thereby holding the target plate flush with the front face of the housing and further allowing resilient depression of the switches, whereby the screws are removable for allowing the target plate to be removed for cleaning;

an actuator button adapted to communicate an actuating signal upon the depression thereof; and control circuitry coupled to the mounting board and connected to the lamp, the display, the switches, the actuator button and a transformer adapted to supply power thereto upon the receipt of an alternating current from a conventional power receptacle, the control circuitry adapted to actuate the lamp, the control circuitry further having timing capabilities wherein the control circuitry is adapted to depict an incrementing timer on the display upon the receipt of the actuating signal from the actuator button, the control circuitry further adapted to stop the timer, turn off the lamp, and depict the time at which the timer stopped on the display upon the depression of at least one of the push button switches.

* * * * *